US005141453A

United States Patent [19]

Fusselman et al.

[11] Patent Number: 5,141,453

[45] Date of Patent: Aug. 25, 1992

[54] CONNECTORS WITH GROUND STRUCTURE

[75] Inventors: David F. Fusselman, Middletown; Peter K. Townsend, Camp Hill, both of Pa.

[73] Assignee: E. I. Du Pont de Nemours and Company, Wilmington, Del.

[21] Appl. No.: 766,987

[22] Filed: Sep. 27, 1991

Related U.S. Application Data

[62] Division of Ser. No. 536,855, Jun. 8, 1990, abandoned.

[51] Int. Cl.[5] ..... H01R 13/648

[52] U.S. Cl. ..... 439/608; 439/108

[58] Field of Search ..... 439/81, 80, 607-610, 439/79, 108, 95

[56] References Cited

U.S. PATENT DOCUMENTS

| | | | |
|---|---|---|---|
| 4,451,107 | 5/1984 | Dola et al. | 339/143 |
| 4,568,134 | 2/1986 | DeMondi | 339/17 |
| 4,601,527 | 7/1986 | Lemke | 339/14 |
| 4,655,518 | 4/1987 | Johnson et al. | 339/17 |
| 4,686,607 | 8/1987 | Johnson | 361/413 |
| 4,806,107 | 2/1989 | Arnold et al. | 439/79 |
| 4,824,383 | 4/1989 | Lemke | 439/108 |
| 4,836,791 | 6/1989 | Grabbe et al. | 439/79 |
| 4,840,573 | 6/1989 | Seidel et al. | 439/92 |
| 4,846,727 | 7/1989 | Glover et al. | 439/608 |
| 4,867,690 | 9/1989 | Thumma | 439/79 |
| 4,869,677 | 9/1989 | Johnson et al. | 439/80 |
| 4,874,319 | 10/1989 | Hasircoglu | 439/608 |
| 4,898,546 | 2/1990 | Elco et al. | 439/608 |
| 4,914,062 | 4/1990 | Voltz | 439/608 |
| 4,952,172 | 8/1990 | Barkus et al. | 439/532 |
| 4,959,024 | 9/1990 | Czeschka | 439/607 |
| 4,959,626 | 9/1990 | Mouissie | 439/607 |
| 4,975,084 | 12/1990 | Fedder et al. | 439/608 |

FOREIGN PATENT DOCUMENTS

| | | | |
|---|---|---|---|
| 0365179 | 4/1990 | European Pat. Off. | 13/658 |
| 3904461 | 9/1990 | Fed. Rep. of Germany | 13/658 |

*Primary Examiner*—Gary F. Paumen
*Assistant Examiner*—Hien D. Vu
*Attorney, Agent, or Firm*—John E. Griffiths

[57] ABSTRACT

The present invention relates to electrical connectors with a ground structure for impedance and cross talk control between signal carrying conductors.

5 Claims, 4 Drawing Sheets

CONNECTORS WITH GROUND STRUCTURE

CROSS REFERENCE TO RELATED APPLICATION

This is a divisional application of copending U.S. patent application Ser. No. 07/536,855 filed Jun. 8, 1990 now abandoned.

BACKGROUND OF THE INVENTION

1. Field of the Invention

This invention relates to electrical connectors with a ground structure for impedance and cross talk control between signal carrying conductors.

2. Description of Related Art

With the advance of technology, a high density of electronic circuits and components can be located on a printed wiring board or printed circuit board (PCB). Along with this miniaturization of electronic circuits and components, electrical connectors are needed to electrically and mechanically interconnect one PCB, such as a back panel or mother board, to one or more other PCBs, such as daughter boards. Further, it is typically desirable for such connectors to have a high signal density capacity. That is, the connectors should permit a high number of signals to pass through the connector per unit volume of the connector. However, electrical signals carried on a conductor can interfere with a signal carried on an adjacent conductor.

This interfering electrical effect that an electrical signal carried on a given conductor exerts on a signal carried on an adjacent conductor is referred to as "cross talk." Controlling this cross talk is especially important in high density connectors. Such control can be implemented in a variety of ways.

One method of controlling cross talk is to connect certain terminals in a high density connector to conductive areas of a printed circuit board that are in turn grounded or connected to a predetermined ground potential. This solution is external to the connector.

U.S. Pat. Nos. 4,655,518 (to Lennart B. Johnson et al.), 4,686,607 (to Lennart B. Johnson) and 4,869,677 (to Lennart B. Johnson et al.) disclose a daughter board-/backplane assembly with contact elements dedicated for grounding purposes. Header contact elements have contacts that can be connected to ground or a predetermined potential on a backplane. The header contact elements have other spring contacts carried by an inside header wall for touching contacts carried by a right angle receptacle outer wall. Other contacts are integral with and perpendicular to the contacts carried by the right angle receptacle outer wall for connection to the daughter board.

U.S. Pat. No. 4,601,527 issued to Timothy A. Lemke discloses an internal shielding structure for connectors, specifically in vertical and right angle headers. The shielding structure includes a ground strip affixed to a mating surface of a header housing. The shielding structure further includes an elongated conductive spring contact with contact beams that extend in holes of side walls of the housing, lock tabs that connect to the ground strip and ground bars for connection to a grounded chassis.

U.S. Pat. No. 4,824,383 issued to Timothy A. Lemke discloses a shielding structure in connectors or plug-type terminators for either a multiple conductor cable or a multiple tracing substrate that electrically isolates individual or groups of contact elements in the terminator to prevent or minimize cross talk between adjacent conductors and to prevent or minimize degradation of signal transmission. The terminator includes a ground structure with generally U-shaped channels. Contact elements extend into the channels. The ground structure is connected to a predetermined potential, rather than dedicating some of the contact elements for this purpose.

U.S. Pat. No. 4,898,546 issued to Richard A. Elco et al. discloses a ground shield device for right angle connectors. A different one of the shield devices straddles alternate columns of contact elements in the connector. Each shield device clips to a tail of one of the contact elements straddled by the shield device. The shield devices are connected to ground or a predetermined potential.

It is an object of this invention to provide high density electrical connectors for electrically and mechanically interconnecting electronic circuits and/or components controlling impedance and/or cross talk within the connectors.

Furthermore, it is an object of this invention to provide high density electrical connectors for electrically and mechanically interconnecting a circuit assembly and a plurality of terminals arranged in rows and columns in a mating connector to control impedance and-/or cross talk thereby to reduce, prevent or minimize degradation of signal transmission within the receptacles.

SUMMARY OF THE INVENTION

The present invention is directed to an electrical connector for electrically and mechanically interconnecting a circuit assembly and a mating connector having a plurality of terminals, each terminal having a contact portion, the first contact portions arranged in rows and columns, the electrical connector comprising:

- a plurality of electrical contact elements wherein:
  - each of the contact elements has a first contact and a second contact, the contact elements comprising a first set and a second set,
  - the first contacts are arranged in rows and columns for contacting the contact portions, and
  - the first set includes a middle portion configured such that their second contacts extend at an angle or perpendicularly with respect to the first contacts,
- a housing including:
  - a conductive base having a plurality of passages arranged in rows and columns extending through the base, the second set of the contact elements positioned in some of the passages and electrically connected to the base,
  - insulative blocks positioned in a remainder of the passages, the blocks having passages, the first set of the contact elements in the block passages such that their first contacts are on a first side of the base in the contact region and their second contacts are on a second side of the base, and
  - a conductive baffle positioned between and spaced from columns of the middle portions of the contact elements in the first set, the baffles being connected to the conductive base.

BRIEF DESCRIPTION OF THE DRAWINGS

The invention can be more fully understood from the following detailed description thereof in connection with accompanying drawings which form a part of this application and in which.

DESCRIPTION OF THE PREFERRED EMBODIMENT(S)

Figure 1:
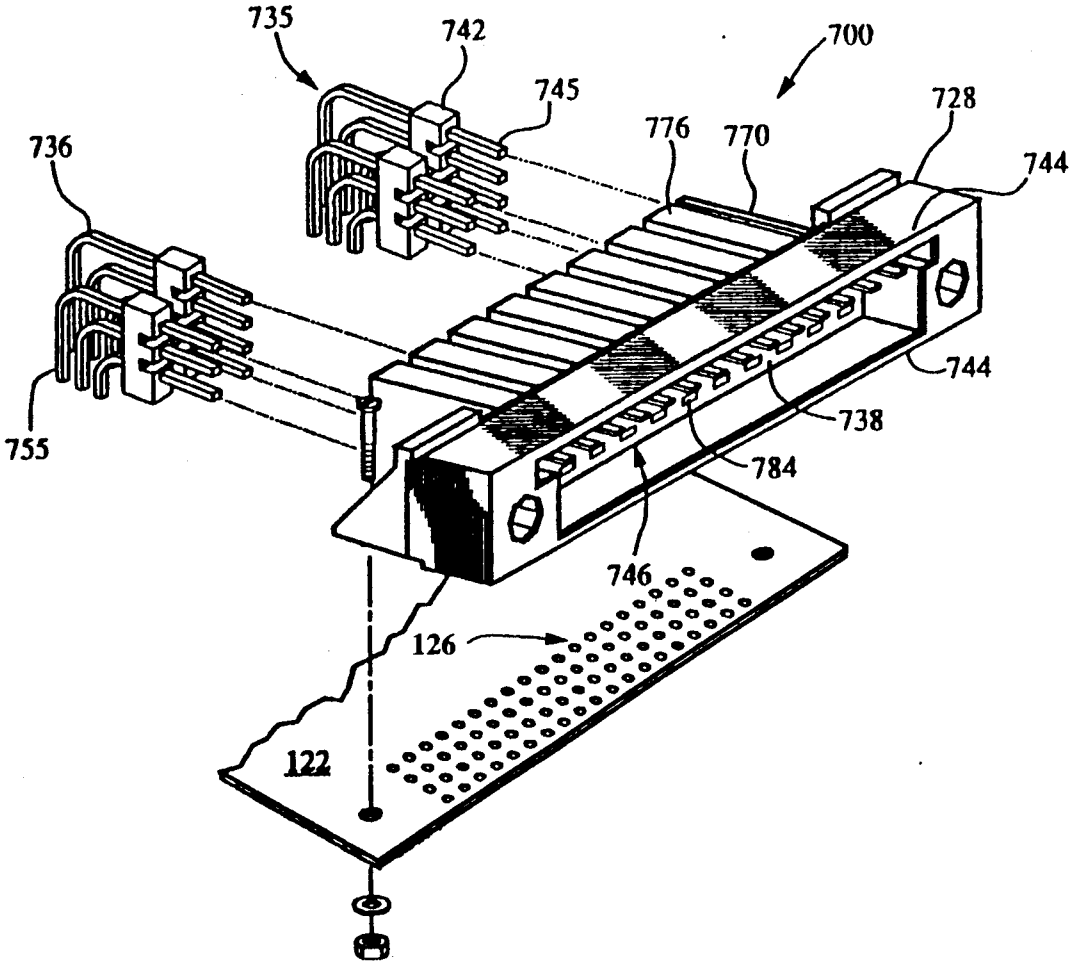
FIG. 1 is an exploded perspective view of a high density connector assembly in accordance with the present invention, the assembly including a high density angled or right angle connector for interconnecting a circuit assembly and a mating connector.

Throughout the following detailed description, similar reference characters refer to similar elements in all figures of the drawings.

Referring to FIG. 1, there is illustrated an exploded perspective view of a high density connector assembly in accordance with the present invention. The assembly includes a high density angled or right angle connector or header 700 for interconnecting a circuit assembly 122 and a mating connector (not depicted). The connector 700 comprises a high density angled or right angle header 700 for interconnecting the circuit assembly 122 having a plurality of contact areas 126 and a mating receptacle including a plurality of terminals with a plurality of contact portions arranged in rows and columns in a receptacle housing. Suitable connectors that can be used for mating with the connector 700 of the present invention are disclosed in U.S. patent application Ser. No. 07/536,855 filed Jun. 8, 1990 now abandoned, which is hereby incorporated by reference.

Figure 2:
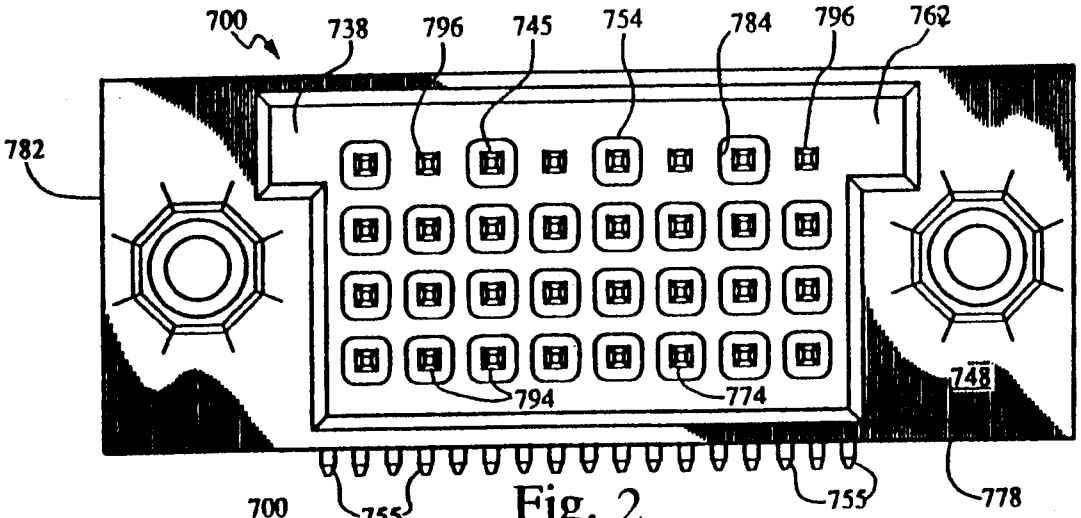
FIG. 2 is an enlarged view of a top or first mating side of the high density angled or right angle connector of FIG. 1.
Figure 4:
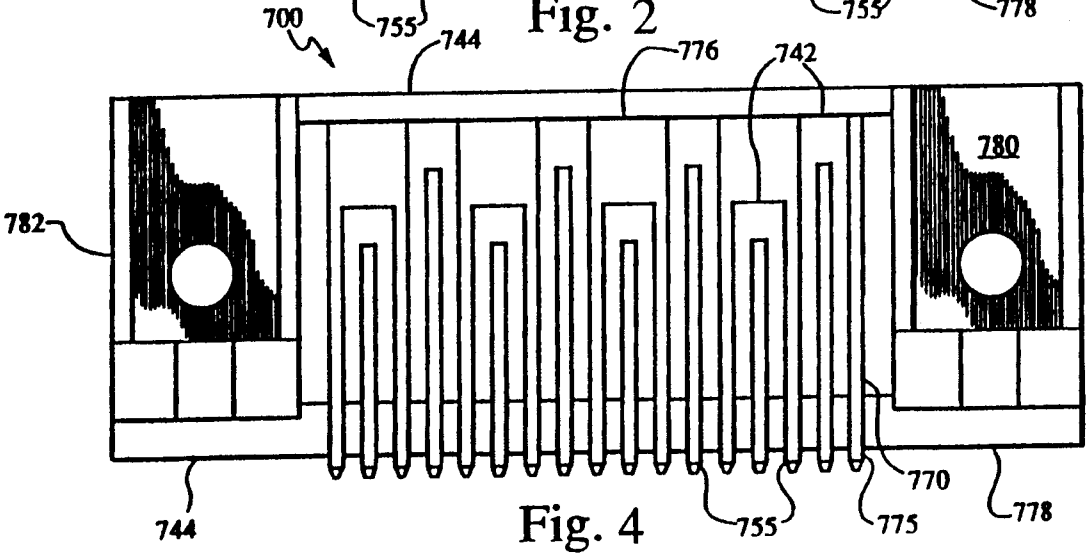
FIG. 4 is an enlarged view of a bottom side of the angled or right angle connector of FIG. 1.
Figure 3:
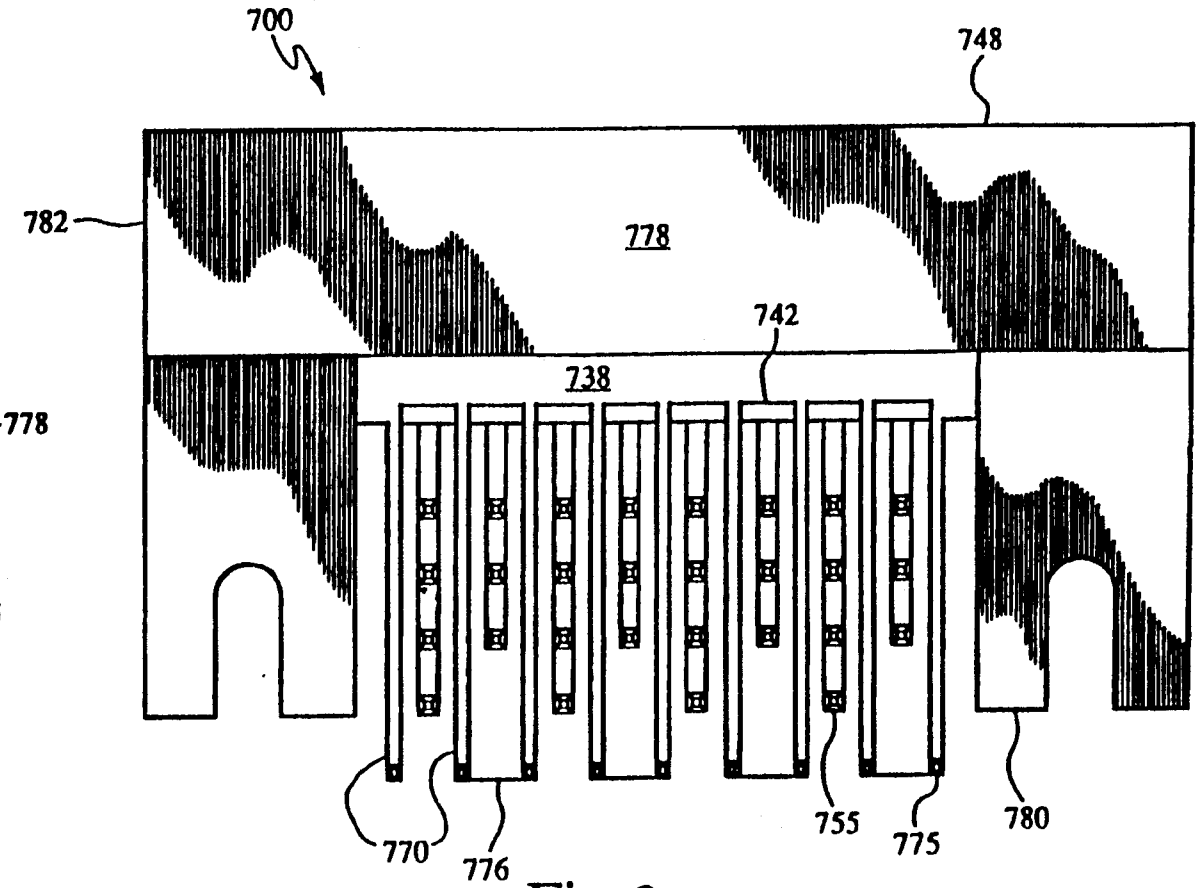
FIG. 3 is an enlarged view of a front or second mating side of the angled or right angle connector of FIG. 1.
Figure 5:
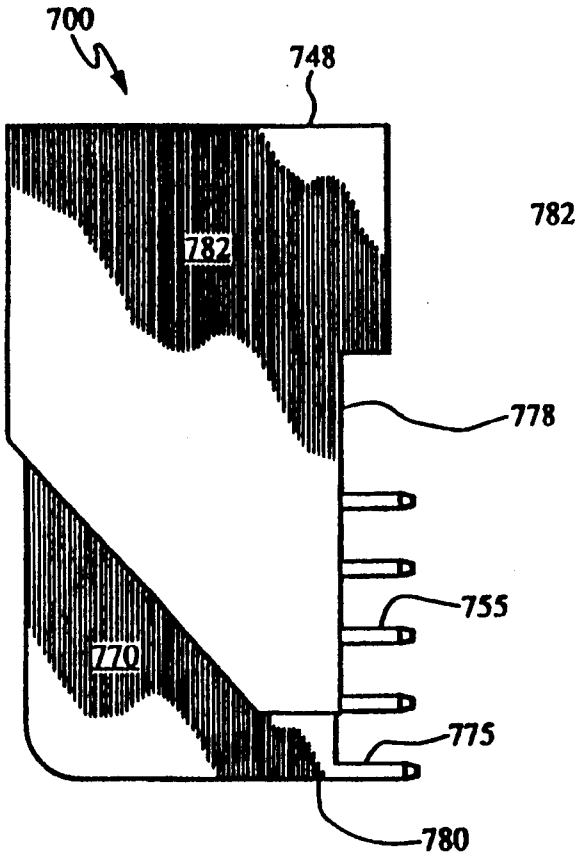
FIG. 5 is an enlarged view of an end of the angled or right angle connector of FIG. 1.
Figure 6:
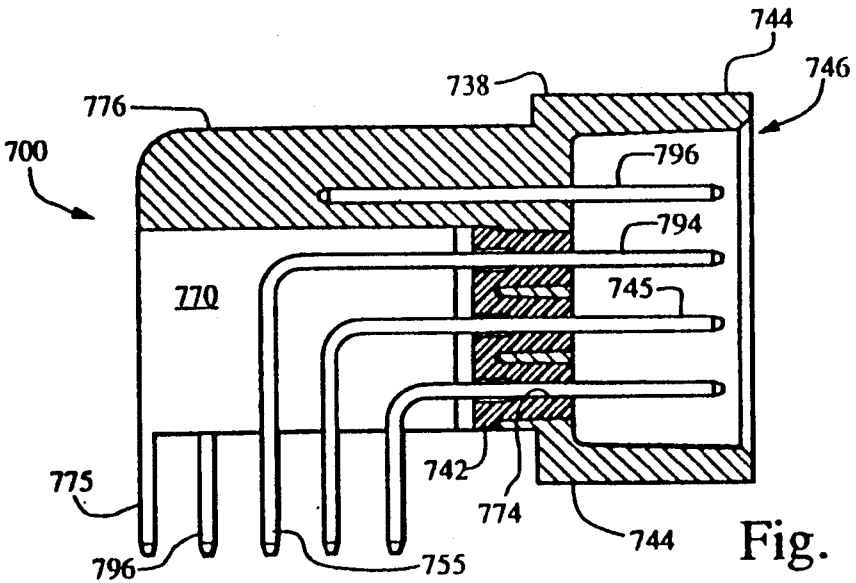
FIG. 6 is a sectional view of the angled or right angle connector of FIGS. 1-5.

FIG. 2 is an enlarged view of a top or first mating side 748 of the high density angled or right angle header 700 of FIG. 1. FIG. 3 is an enlarged view of a front or second mating side 778 of the angled or right angle header 700 of FIG. 1. FIG. 4 is an enlarged view of a bottom side 780 of the angled or right angle header 700 of FIG. 1. FIG. 5 is an enlarged view of an end 782 of the angled or right angle header 700 of FIG. 1. FIG. 6 is a cross sectional view of the header 700.

The angled or right angle header 700 comprises a plurality of conductive electrical contact elements 735; a housing 728 which includes a conductive base 738, insulative blocks 742, at least one conductive baffle 70 and a baffle contact 775 extending from each one of the conductive baffles 770.

The conductive electrical contact elements 735 may have any configuration so long as they are useable as angled or right angle contact elements. In other words, they may be male elements, female elements or gender neutral. More specifically, each one of the electrical contact elements 735 has a first contact 745 and a second contact 755. Preferably, the first contacts 745 and the second contacts 755 may be distal end portions of a pin generally having a 0.24 inches by 0.24 inches square cross section. One of the contact elements 735 is in each passage 784 through the base 738 with the first contacts 745 positioned in a contact region 746 for contacting one of the contact portions of a mating connector. The first contacts 745 are generally parallel to one another and arranged in rows and columns. There can be any number of rows and any number of columns of the first contacts 745. However, there are preferably at least two rows and at least two columns. Typically, there are three, four, five or six rows of the first contacts 745. The Figures depict four rows of the first contacts 745. Typically, there are many columns of the first contacts 745. Referring to FIG. 2, the contact elements 735 comprise a first set 794 and a second set 796. The first set 794 of the contact elements 735 has a middle portion 736 configured such that their second contacts 755 extend at an angle or perpendicularly with respect to the first contacts 745. The middle portions 736 may have a right angle bend, two 45 degree angle bends, etc. The second contacts 755 can be through mount contacts or surface mount contacts.

Referring to FIGS. 1-3, the conductive base 738 has a plurality of passages 784 arranged in rows and columns extending through the base 738. One of the contact elements 735 is in each of the passages 784 with the first contacts 745 positioned on a first side of the base 738 in the contact region 746 for contacting one of the contact portions of a mating connector. The second contacts 755 are positioned on a second side of the base 738. The second set 796 of the contact elements 735 is positioned in some of the passages 784 and electrically connected to the base 738. The insulative blocks 742 are positioned in a remainder of the passages 784. The blocks 742 have passages 774. The first set 794 of the contact elements 735 are insulated from the base 738 by passing through the block passages 774 such that their first contacts 745 are on a first side of the base 738 in the contact region 746 and their second contacts 755 are on a second side of the base 738. The block 742 may comprise an insulative sleeve 754 surrounding each of the contact elements 735 in the first set 794. The sleeves 754 associated with each column of the contact elements 735 may be connected to the same block 742 as best seen in FIG. 1.

One of the conductive baffles 770 is positioned between and spaced from columns of the middle portions 736 of the contact elements 735 in the first set 794. The baffles 770 are electrically connected to the conductive base 738. A baffle contact 775 may extend from each one of the conductive baffles 770 such that the second contacts 755 and the baffle contacts 775 are arranged in rows and columns for connecting to the contact regions 126 of the circuit assembly 122. The baffle contacts 775 can have the same or a different shape than the second contacts 755. For instance, both the second contacts 755 and the baffle contacts 775 can be pin shaped, but the cross section of one of them, such as the baffle contacts 775 can be larger than the cross section of the other. The baffle contacts 775 can be integrally cast out of the same metal with the base 738 and the baffles 770. Alternatively, the baffle contacts 775 can be conductive pins secured in holes in or through the baffles 770. Referring to FIGS. 1, 3 and 6, a conductive wall 776 may connect adjacent pairs of the baffles 770. The conductive walls 776 extend generally perpendicularly from the base 738. The conductive wall 776 may extend along and connect all of the baffles 770. For instance, the wall 776 can extend along the top and left sides of the connector 700 in FIG. 6 substantially enclosing some or all of the bent portions 736.

The housing 728 may further comprise conductive side walls 744 extending generally perpendicularly from the base 738. The base 738 and the conductive side walls 744 partially enclose the contact region 746.

The first contacts 745 of the high density header 700 can connect to any connector having a plurality of terminals or contact elements with a plurality of contact portions arranged in rows and columns in a connector. The connector that is mateable with the header 700 can be a vertical receptacle or an angled or right angle receptacle. Preferably, the terminals of the receptacle that is mateable with the header 700 have socket shaped contact portions for engaging the first contacts 745 of the header 700.

The circuit assembly 122 can be any assembly that includes a plurality of conductors, leads, plated through holes or conductive paths, pads or areas 126. The circuit assembly 122 can be a printed wiring board or a printed circuit board, such as a backpanel, a mother board or a daughter board. The circuit assembly 122 can be a cable assembly. The circuit assembly 122 can be rigid or flexible. In one typical situation, the header 700 is for electrically and mechanically interconnecting a backpanel or mother board 122 and a mating receptacle which, in turn, is for electrically and mechanically connecting to a daughter board that is perpendicular to the mother board 122.

It will be recognized by those skilled in the art that the ground structure of the present invention can be modified to be used on any angled receptacle or header where the two contacts of the contact elements of the receptacle or header are at an angle other than 180 degrees from one another.

The parts referred to throughout this specification can be made from known materials used to make similar conventional parts. For instance, the insulative housings can be made of various plastics, such as polyetherimide resin or polyphenylene sulfide resin. The conductive walls, conductive bases, baffles and shields can be made of any nonmagnetic metal or metal alloy including zinc, aluminum, copper, brass or alloys thereof. The contact elements of the present invention can be made from any suitable metal used for electrical terminals, such as brass, phosphor bronze, beryllium copper and the like. The contact elements may be plated or coated with a conductive layer, such as tin, nickel, palladium, gold, silver or a suitable alloy.

Those skilled in the art, having the benefit of the teachings of the present invention as hereinabove set forth, can effect numerous modifications thereto. These modifications are to be construed as being encompassed within the scope of the present invention as set forth in the appended claims.

What is claimed is:

1. An electrical connector for electrically and mechanically interconnecting a circuit assembly and a mating connector having a plurality of terminals, each terminal having a contact portion, the first contact portions arranged in rows and columns, the electrical connector comprising:

a plurality of electrical contact elements wherein:

each of the contact elements has a first contact and a second contact, the contact elements comprising a first set and a second set, the first contacts are arranged in rows and columns for contacting the contact portions, and the first set includes a middle portion configured such that their second contacts extend at an angle with respect to the first contacts, a housing including:

a conductive base having a plurality of passages arranged in rows and columns extending through the base, the second set of the contact elements positioned in some of the passages and electrically connected to the base, a plurality of insulative blocks positioned in a remainder of the passages, the blocks having passages, the first set of the contact elements being in the block passages such that their first contacts are on a first side of the base in a contact region and their second contacts are on a second side of the base, and conductive baffles positioned between and spaced from columns of the middle portions of the contact elements in the first set, the baffles being connected to the conductive base.

2. The electrical connector of claim 1, wherein each one of the insulative blocks includes the block passages for holding a column of the first set of the contact elements.

3. The electrical connector of claim 1, further comprising:

conductive side walls extending from the base, the base and the conductive side walls partially enclosing the contact region.

4. The electrical connector of claim 1, further comprising:

a baffle contact extends from each one of the conductive baffles such that the second contacts and the baffle contacts are arranged in rows and columns for connecting to the contact regions of the circuit assembly.

5. The electrical connector of claim 4, further comprising:

a conductive wall connects adjacent pairs of the baffles, the conductive wall extending from the base.

* * * * *